US011892178B2

(12) United States Patent
Kamada

(10) Patent No.: US 11,892,178 B2
(45) Date of Patent: Feb. 6, 2024

(54) HEAT EXCHANGER UNIT AND AIR CONDITIONER USING THE SAME

(71) Applicant: DAIKIN INDUSTRIES, LTD., Osaka (JP)

(72) Inventor: Toshimitsu Kamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 93 days.

(21) Appl. No.: 16/474,427

(22) PCT Filed: Dec. 25, 2017

(86) PCT No.: PCT/JP2017/046453
§ 371 (c)(1),
(2) Date: Jun. 27, 2019

(87) PCT Pub. No.: WO2018/123981
PCT Pub. Date: Jul. 5, 2018

(65) Prior Publication Data

US 2019/0346158 A1 Nov. 14, 2019

(30) Foreign Application Priority Data

Dec. 28, 2016 (JP) ..... 2016-256424

(51) Int. Cl.
*F24F 1/0067* (2019.01)
*F28D 1/047* (2006.01)
(Continued)

(52) U.S. Cl.
CPC ..... *F24F 1/0067* (2019.02); *F28D 1/0477* (2013.01); *F28D 1/05341* (2013.01);
(Continued)

(58) Field of Classification Search
CPC ..... F24F 1/0067; F28D 1/0477; F28D 1/05341; F28F 1/32; F28F 2210/02
See application file for complete search history.

(56) References Cited

U.S. PATENT DOCUMENTS 5,613,554 A * 3/1997 Bull ..... F24F 13/22 165/122
6,276,443 B1 * 8/2001 Martin, Sr. ..... F28D 1/0477 165/124
(Continued)

FOREIGN PATENT DOCUMENTS

EP 2157389 A1 2/2010
EP 3141857 A1 3/2017
(Continued)

OTHER PUBLICATIONS

Machine translation of WO-2010146852-A1 Description and Claims (Year: 2020).*
(Continued)

*Primary Examiner* — Elizabeth J Martin
(74) *Attorney, Agent, or Firm* — Osha Bergman Watanabe & Burton LLP

(57) ABSTRACT

A heat exchanger unit includes: a heat exchanging section that includes: a plurality of heat transfer fins; and a plurality of heat transfer tubes that each passes through a corresponding one of the plurality of heat transfer fins, in which, in the heat exchanging section, the plurality of heat transfer tubes that are arranged in L or more levels in a direction that intersects an air flow and in M rows in a direction of the air flow, each of the plurality of heat transfer tubes belongs to one of N paths, an inlet of each of the N paths is disposed at a first end of the heat exchanging section in a level direction, an outlet of each of the N paths is disposed at a second end of the heat exchanging section in the level direction, and M<N.

3 Claims, 10 Drawing Sheets

(51) Int. Cl.

| | |
|---|---|
| ***F28D 1/053*** | (2006.01) |
| ***F28F 1/32*** | (2006.01) |
| ***F25B 39/02*** | (2006.01) |
| ***F25B 39/04*** | (2006.01) |

(52) U.S. Cl.
CPC ..... *F28F 1/32* (2013.01); *F25B 39/02* (2013.01); *F25B 39/04* (2013.01); *F28F 2210/02* (2013.01)

(56) References Cited

U.S. PATENT DOCUMENTS

| | | | | |
|---|---|---|---|---|
| 6,820,685 | B1 * | 11/2004 | Carter | F28B 1/06 165/150 |
| 7,003,972 | B2 | 2/2006 | Eom et al. | |
| 7,185,513 | B2 * | 3/2007 | Bush | F25B 39/022 62/515 |
| 2016/0238276 | A1 * | 8/2016 | Andrew | B01D 46/4263 |
| 2018/0209742 | A1 * | 7/2018 | Jiang | F28D 1/0477 |

FOREIGN PATENT DOCUMENTS

| | | | | | |
|---|---|---|---|---|---|
| JP | H09138033 | A | | 5/1997 | |
| JP | 2000081255 | A | | 3/2000 | |
| JP | 2001304783 | A | | 10/2001 | |
| JP | 2001304783 | A | * | 10/2001 | F25B 2400/12 |
| JP | 2007163013 | A | * | 6/2007 | F25B 39/00 |
| JP | 2007163013 | A | | 6/2007 | |
| JP | 2007271209 | A | | 10/2007 | |
| JP | 2007271209 | A | * | 10/2007 | F28F 21/085 |
| JP | 201736900 | A | | 2/2017 | |
| WO | 2008126733 | A1 | | 10/2008 | |
| WO | WO-2010089920 | A1 | * | 8/2010 | F24F 1/0007 |
| WO | WO-2010146852 | A1 | * | 12/2010 | F24F 1/0059 |
| WO | WO-2012114719 | A1 | * | 8/2012 | F25B 39/00 |
| WO | WO-2013146006 | A1 | * | 10/2013 | F28D 1/0477 |
| WO | WO-2014178164 | A1 | * | 11/2014 | F24F 1/0007 |

OTHER PUBLICATIONS

Machine translation of WO-2012114719-A1 Description and Claims (Year: 2020).*

Machine translation of WO-2013146006-A1 Description and Claims (Year: 2020).*

Machine translation of WO-2014178164-A1 Description and Claims (Year: 2020).*

Kawbata, et al., Heat exchanger for air-conditioning and air-conditioning system, May 28, 1997, JPH09138033A, Human Translation, Specification. (Year: 2023).*

English translation of the International Preliminary Report on Patentability issued in Application No. PCT/JP2017/046453, dated Jul. 2, 2019 (7 pages).

International Search Report issued in corresponding application No. PCT/JP2017/046453 dated Mar. 13, 2018 (3 pages).

* cited by examiner

HEAT EXCHANGER UNIT AND AIR CONDITIONER USING THE SAME

CROSS-REFERENCE TO RELATED APPLICATIONS

Priority is claimed to Japanese Patent Application No. 2016-256424 filed on Dec. 28, 2016, the entire content of which is incorporated herein by reference.

TECHNICAL FIELD

The present invention relates to a heat exchanger unit, particularly, to a heat exchanger unit that may be set such that a facing air flow is reversed, and to an air conditioner using the same.

BACKGROUND

In a unitary indoor unit, such as that disclosed in Patent Literature 1 (U.S. Pat. No. 7,003,972), in which a heat exchanger unit and a blower are arranged vertically, the position of the heat exchanger unit and the position of the blower may be reversed due to the demands of the market. Therefore, a top-blow arrangement in which the blower is at an upper side and a bottom-blow arrangement in which the blower is at a lower side are required to provide the same heat exchange performance.

However, when the vertical arrangement of the heat exchanger unit and the blower is reversed, the direction of air flow that moves past a heat exchanging section of the heat exchanger unit is reversed, and a portion where the local wind speed is high is switched between the vicinity of an upper level and the vicinity of a lower level. Therefore, the top-blow arrangement and the bottom-blow arrangement do not easily realize the same heat exchange performance.

One or more embodiments of the present invention provide a heat exchanger unit that realizes the same heat exchange performance even if the direction of air flow that moves past a heat exchanging section of the heat exchanger unit is reversed.

PATENT LITERATURE

<Patent Literature 1> U.S. Pat. No. 7,003,972

SUMMARY

A heat exchanger unit according to one or more embodiments of the present invention includes a heat exchanging section that includes a plurality of heat transfer fins and a plurality of heat transfer tubes passing through a corresponding one of the heat transfer fins. In the heat exchanging section, groups of the plurality of heat transfer tubes that are arranged in L or more levels in a direction that intersects an air flow are arranged in M rows in a direction of the air flow. The plurality of heat transfer tubes form N paths. An inlet of each path is disposed near an end of the heat exchanging section. An outlet of each path is disposed near another end of the heat exchanging section. In addition, M<N. The number of paths that pass through all of the rows at least once is set at one or more.

This heat exchanger unit allows, with M<N, the number of paths that pass at least once through all of the rows to be set at one or more, and the influence of a row where the heat exchange performance is enhanced with respect to only a unidirectional air flow that passes the heat exchanging section to be reduced, to make it possible to reduce a variation width of the heat exchange performance when the direction of air flow that passes the heat exchanging section is reversed.

According to one or more embodiments, all of the paths each pass at least once back and forth between a row that is positioned on a most upstream side with respect to the air flow and a row that is positioned on a most downstream side with respect to the air flow.

This heat exchanger unit allows a path that passes through only a row on an upstream side of the air flow or a row on a downstream side of the air flow to be removed, to make it possible to reduce the variation width of the heat exchange performance when the direction of air flow that passes the heat exchanging section is reversed.

According to one or more embodiments, an outside diameter of each heat transfer tube is 9 mm or less. This heat exchanger unit makes it possible to reduce the size of the heat exchanging section.

According to one or more embodiments, the air flow passes the heat exchanging section in a vertical direction. The inlet of each path is provided at the heat transfer tube within a fifth level from the heat transfer tube that is positioned on an end side in an L-level direction in any of the rows. The outlet of each path is provided at the heat transfer tube within a fifth level from the heat transfer tube that is positioned on another end side in the L-level direction in any of the rows.

When this heat exchanger unit is to function as an evaporator, it is possible to provide a structure in which the heat transfer tube within the fifth level from the heat transfer tube on a lower end side is defined as an inlet of a liquid-rich two-phase refrigerant and the heat transfer tube within the fifth level from the heat transfer tube on an upper end side is defined as an outlet of a superheated gas refrigerant. Therefore, the top-blow arrangement and the bottom-blow arrangement can provide the same heat exchange performance.

Occurrence of refrigerant drift caused by the influence of gravity exerted upon a liquid refrigerant is suppressed, and concern for a reduction in performance is overcome.

According to one or more embodiments, an air conditioner includes the heat exchanger unit.

The heat exchanger unit according to one or more embodiments of the present invention allows, with M<N, the number of paths that pass at least once through all of the rows to be set at one or more, and the influence of a row where the heat exchange performance is enhanced with respect to only a unidirectional air flow that passes the heat exchanging section to be reduced, to reduce the variation width of the heat exchange performance when the direction of air flow that passes the heat exchanging section is reversed.

The heat exchanger unit according to one or more embodiments of the present invention allows a path that passes through only a row on the upstream side of the air flow or a row on the downstream side of the air flow to be removed, to reduce the variation width of the heat exchange performance when the direction of air flow that passes the heat exchanging section is reversed.

The heat exchanger unit according to one or more embodiments of the present invention makes it possible to reduce the size of the heat exchanging section.

When the heat exchanger unit according to one or more embodiments of the present invention functions as an evaporator, it is possible to provide a structure in which the heat transfer tube within the fifth level from the heat transfer tube on the lower end side is defined as an inlet of a liquid-rich two-phase refrigerant and the heat transfer tube within the fifth level from the heat transfer tube on the upper end side is defined as an outlet of a superheated gas refrigerant. Therefore, the top-blow arrangement and the bottom-blow arrangement can provide the same heat exchange performance.

Occurrence of refrigerant drift caused by the influence of gravity exerted upon a liquid refrigerant is suppressed, and concern for a reduction in performance is overcome.

In the air conditioner according to one or more embodiments of the present invention, the heat exchanger unit allows, with M<N, the number of paths that pass at least once through all of the rows to be set at one or more, and the influence of a row where the heat exchange performance is enhanced with respect to only a unidirectional air flow that passes the heat exchanging section to be reduced, to reduce the variation width of the heat exchange performance when the direction of air flow that passes the heat exchanging section is reversed.

DETAILED DESCRIPTION

Embodiments of the present invention are described below with reference to the drawings. The embodiments below are examples of the present invention and do not limit the technical scope of the present invention.

(1) Structure of Air Conditioner

Figure 1:
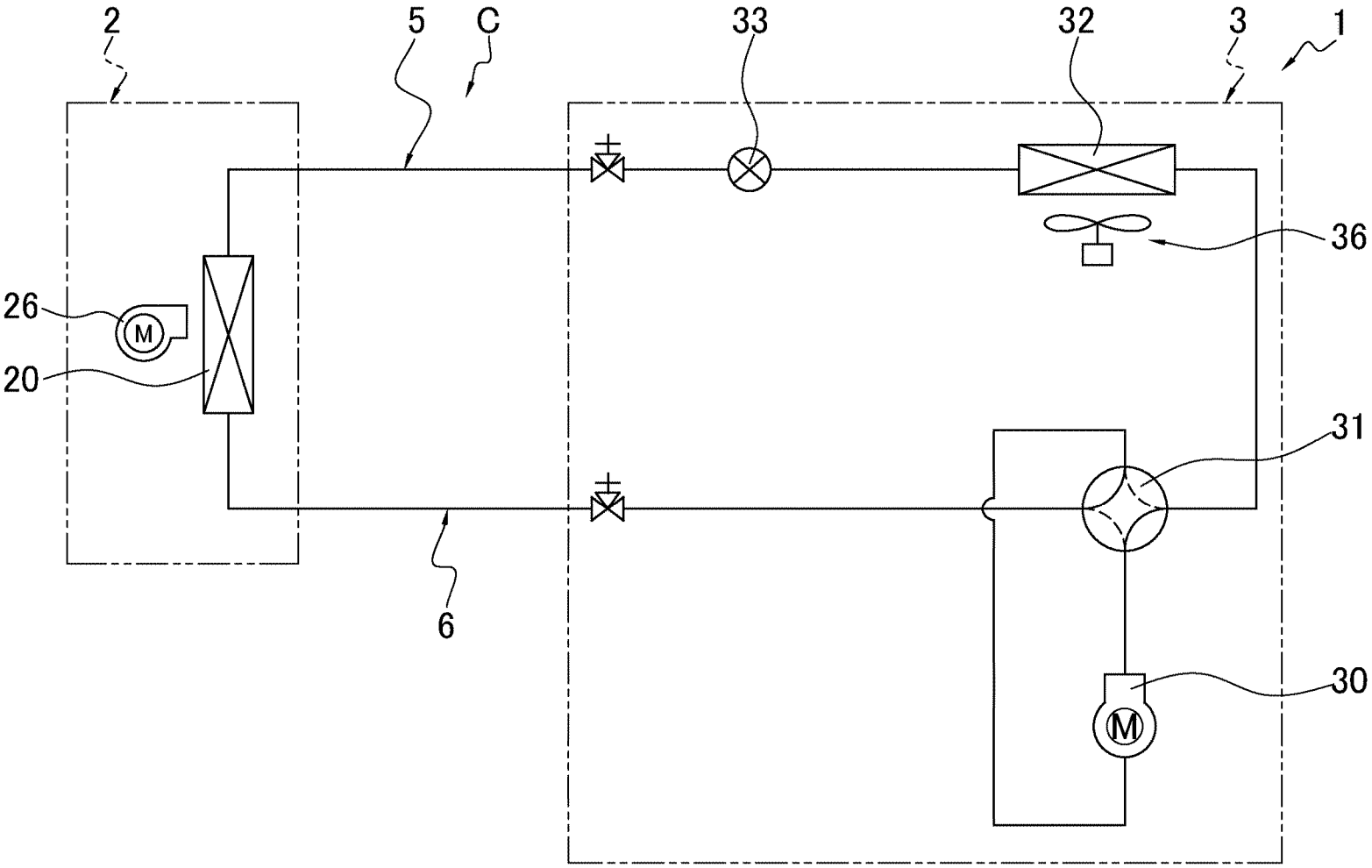
FIG. 1 is a refrigerant circuit diagram of an air conditioner according to one or more embodiments of the present invention.

FIG. 1 is a refrigerant circuit diagram of an air conditioner 1 according to one or more embodiments of the present invention. In FIG. 1, the air conditioner 1 includes an indoor unit 2 and an outdoor unit 3 that is coupled to the indoor unit 2 via pipes 5 and 6. Ordinarily, the indoor unit 2 is set indoors, and the outdoor unit 3 is set outdoors.

The air conditioner 1 includes a refrigerant circuit C in which a refrigerant circulates. In the refrigerant circuit C, an indoor heat exchanger 20 that belongs to the indoor unit 2, and a compressor 30, a four-way switching valve 31, an outdoor heat exchanger 32, and an expansion valve 33 that belong to the outdoor unit 3 are connected to each other.

The indoor unit 2 includes an indoor fan 26. The indoor fan 26 operates to cause an air flow that exchanges heat with the indoor heat exchanger 20 to be produced. The outdoor unit 3 includes an outdoor fan 36. The outdoor fan 36 operates to cause an air flow that exchanges heat with the outdoor heat exchanger 32 to be produced.

(2) Circulation of Refrigerant (2-1) Cooling Operation

In a cooling operation, the four-way switching valve 31 is set in a first state (solid line in FIG. 1). When, in this state, a control unit (not shown) causes the compressor 30 to operate, a vapor compression refrigeration cycle in which the outdoor heat exchanger 32 becomes a condenser and the indoor heat exchanger 20 becomes an evaporator is performed.

A high-pressure refrigerant discharged from the compressor 30 exchanges heat with outdoor air and is condensed at the outdoor heat exchanger 32. The refrigerant that has exited from the outdoor heat exchanger 32 has its pressure reduced when the refrigerant passes through the expansion valve 33, and then exchanges heat with indoor air and is evaporated at the indoor heat exchanger 20. Here, the air is cooled by the indoor heat exchanger 20, and the cooled air is blown out into a room from a blow-out port via the indoor fan 26. The refrigerant that has exited from the indoor heat exchanger 20 is sucked into the compressor 30 and is compressed.

(2-2) Heating Operation

In a heating operation, the four-way switching valve 31 is set in a second state (dotted line in FIG. 1). When, in this state, the control unit (not shown) causes the compressor 30 to operate, a vapor compression refrigeration cycle in which the outdoor heat exchanger 32 becomes an evaporator and the indoor heat exchanger 20 becomes a condenser is performed.

A high-pressure refrigerant discharged from the compressor 30 exchanges heat with indoor air and is condensed at the indoor heat exchanger 20. Here, the air has its temperature increased at the indoor heat exchanger 20, and the heated air is blown out into a room from the blow-out port via the indoor fan 26. The condensed refrigerant has its pressure reduced when the refrigerant passes through the expansion valve 33, and then exchanges heat with outdoor air and is evaporated at the outdoor heat exchanger 32. The refrigerant that has exited from the outdoor heat exchanger 32 is sucked into the compressor 30 and is compressed.

(3) Structure of Indoor Unit 2

Figure 2A:
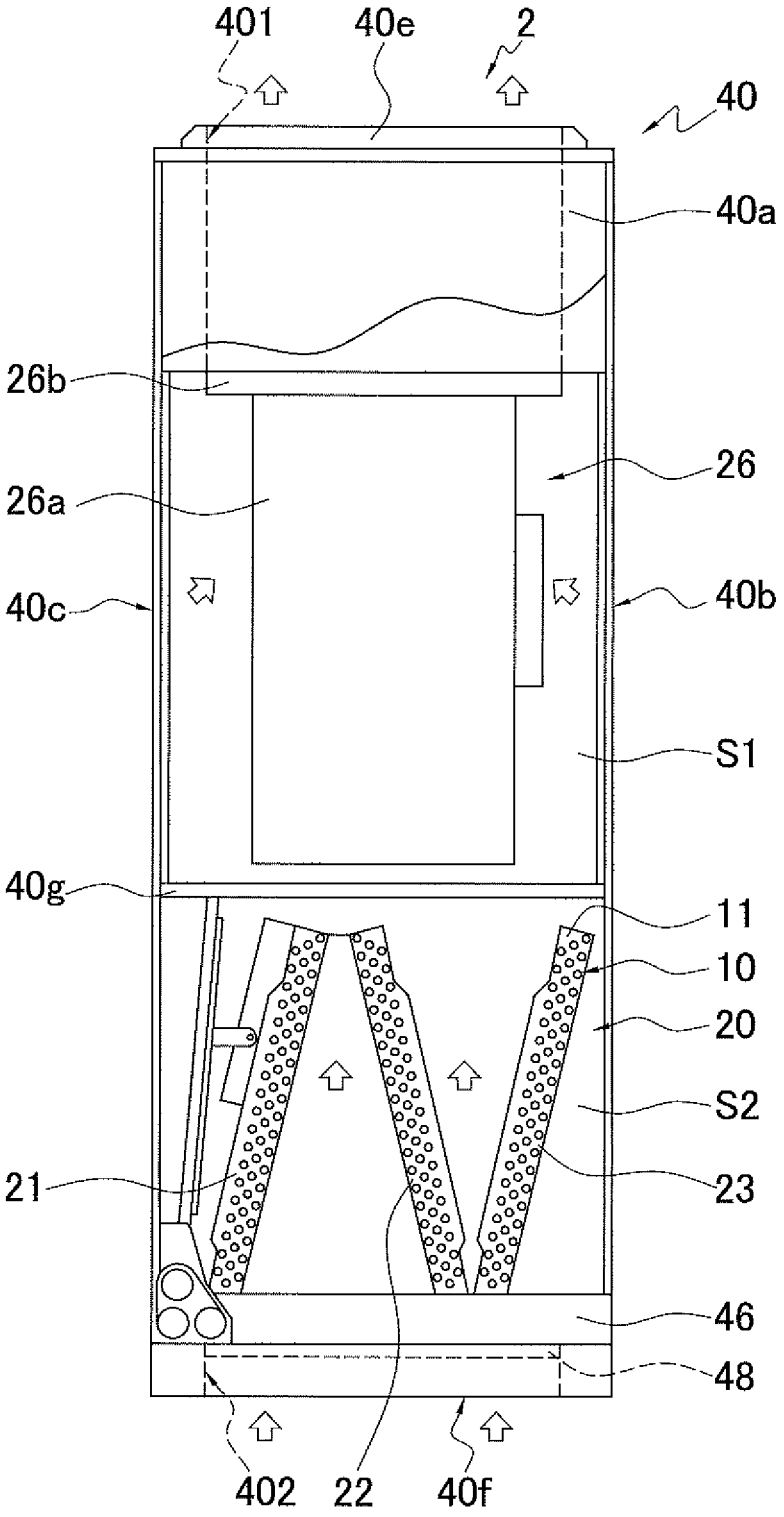
FIG. 2A is a front view of the air conditioner having a top-blow arrangement.

FIG. 2A is a front view of the air conditioner 1 having a top-blow arrangement, and is a front view of the air conditioner 1 in a state in which a front-surface plate 40*a* of the air conditioner 1 is removed. In order to simplify FIG. 2A, FIG. 2A does not show some components other than the main components.

(3-1) Casing 40

In FIG. 2A, a casing 40 of the indoor unit 2 has a substantially rectangular parallelepiped shape, and primarily includes the front-surface plate 40*a*, a right-surface plate 40*b*, a left-surface plate 40*c*, a rear-surface plate (not shown), a top plate 40*e*, and a bottom plate 40*f*.

The right-surface plate 40*b* is positioned on the right when viewed from the side of the front-surface plate 40*a*, and the left-surface plate 40*c* is positioned on the left when viewed from the side of the front-surface plate 40*a*. A blow-out port 401 is formed in the top plate 40*e*. A suction port 402 is formed in the bottom plate 40*f*.

A space inside the casing 40 has a two-level structure, in which an upper side is a fan chamber S1 and a lower side is a heat exchanger chamber S2 with an intermediate frame 40*g* interposed between the chambers S1 and S2. The indoor fan 26 is disposed in the fan chamber S1, and the indoor heat exchanger 20 and a drain pan 46 are disposed in the heat exchanger chamber S2.

The indoor heat exchanger 20 and the drain pan 46 can be drawn out forward and separated from the casing 40.

(3-2) Indoor Heat Exchanger 20

The indoor heat exchanger 20 is a cross-fin-tube type heat exchanger unit. The indoor heat exchanger 20 has a form in which three heat exchanging sections 21, 22, and 23, which have a structure in which a plurality of heat transfer tubes 10 pass through a corresponding one of a plurality of heat transfer fins 11 disposed at predetermined intervals, are arranged in an N shape. The forms of the heat exchanging sections 21, 22, and 23 are described in a section in the latter half.

(3-3) Drain Pan 46

The drain pan 46 is a dish-shaped water conduit made of a sheet metal, and collects drain water condensed at a surface of the indoor heat exchanger 20 and guides the drain water to a drain tube (not shown) that communicates with the outside of the casing 40. The drain pan 46 is disposed along and directly below a lower end of the indoor heat exchanger 20, and has a width that is substantially the same as the width of the indoor heat exchanger 20 in a front-rear direction when viewed from the side of the right-surface plate 40*b* or the side of the left-surface plate 40*c*. Therefore, the drain pan 46 is capable of receiving drain water that drops from the surface of the indoor heat exchanger 20.

(3-4) Indoor Fan 26

The indoor fan 26 is a sirocco fan. When the indoor fan 26 operates, air is sucked in from the suction port 402 that is formed in the bottom plate 40*f*, and the air exchanges heat with a refrigerant while the air passes the indoor heat exchanger 20, and is cooled during a cooling operation and is heated during a heating operation. The cooled or heated air is introduced from beside a fan housing 26*a* of the indoor fan 26, is guided in a peripheral direction along the fan housing 26*a*, and is discharged from a discharge port 26*b*.

Since the discharge port 26*b* communicates with the blow-out port 401, the air discharged from the discharge port 26*b* is blown out to the outside from the blow-out port 401.

A filter 48 is mounted on the suction port 402 of the bottom plate 40*f*, and the filter 48 removes dust contained in the sucked-in air.

(4) Bottom-Blow Arrangement of Air Conditioner

Installation orientations of the air conditioner 1 according to one or more embodiments are the top-blow arrangement and a bottom-blow arrangement. The installation orientation that has been described with reference to FIG. 2A up to now is related to the top-blow arrangement. The bottom-blow arrangement is described below.

Figure 2B:
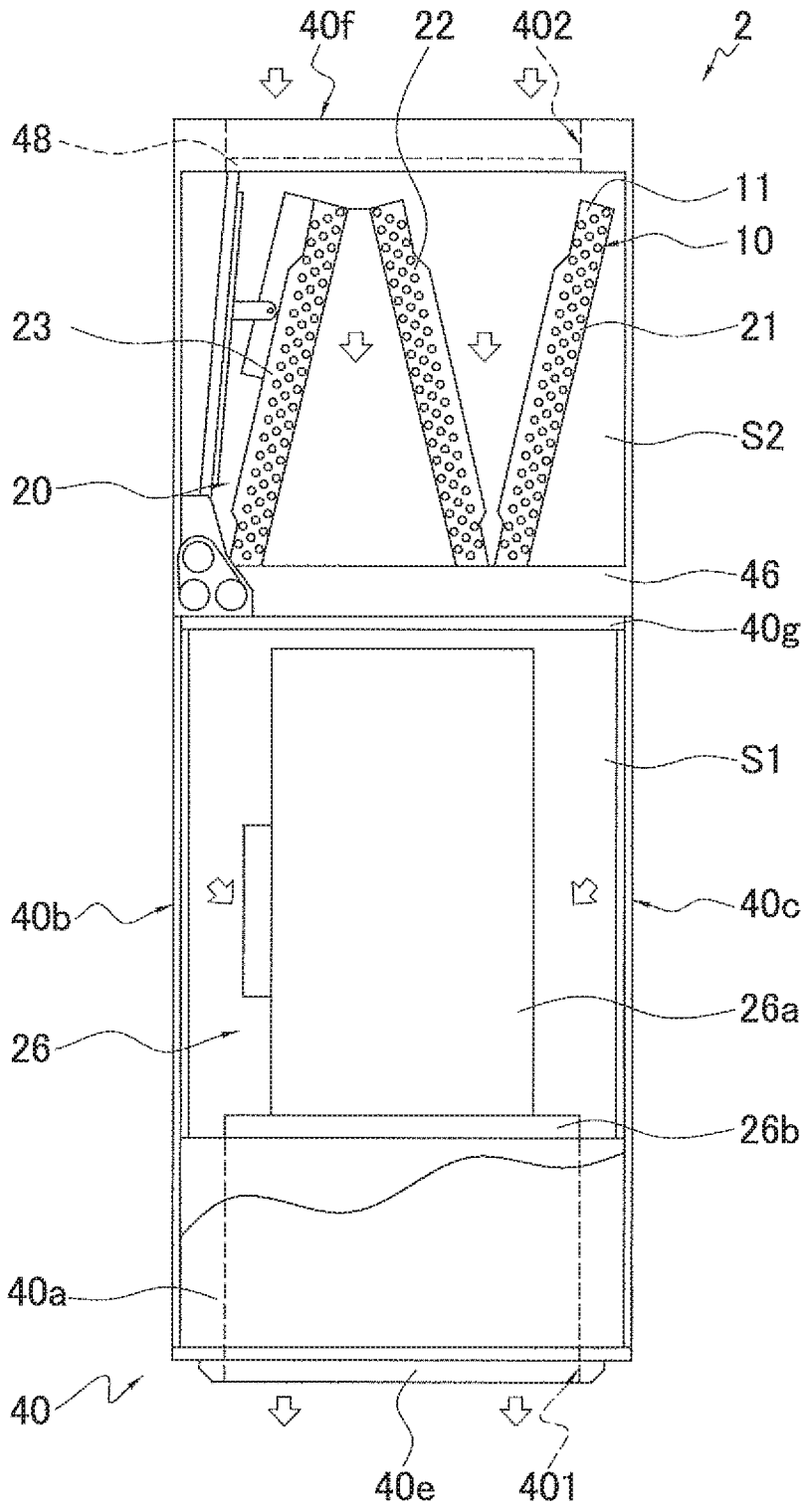
FIG. 2B is a front view of the air conditioner having a bottom-blow arrangement.

FIG. 2B is a front view of the air conditioner 1 having the bottom-blow arrangement. In order to simplify FIG. 2B, FIG. 2B does not show some components other than the main components.

In FIG. 2B, the procedure for setting the bottom-blow arrangement is as follows.

First, the indoor heat exchanger 20 and the drain pan 46 are drawn out forward from the casing 40, and the indoor heat exchanger 20 and the drain pan 46 are caused to be in a separated state from the heat exchanger chamber S2.

Next, the top plate 40*e* is inverted so as to be on a floor side, as a result of which the fan chamber S1 is caused to be on the lower side and the heat exchanger chamber S2 is caused to be on the upper side.

Then, by installing the indoor heat exchanger 20 and the drain pan 46 in the heat exchanger chamber S2, the bottom-blow arrangement is completed. That is, the blow-out port 401 of the top plate 40*e* is on the lower side, and the suction port of the bottom plate 40*f* is on the upper side.

In this state, when the indoor fan 26 operates, air is sucked in from the suction port 402, and the air exchanges heat with a refrigerant while the air passes the indoor heat exchanger 20, and is cooled during a cooling operation and is heated during a heating operation. The cooled or heated air is introduced from beside the fan housing 26*a* of the indoor fan 26, is guided in a peripheral direction along the fan housing 26*a*, and is discharged from the discharge port 26*b*.

Since the discharge port 26*b* communicates with the blow-out port 401, the air discharged from the discharge port 26*b* is blown out to the outside from the blow-out port 401.

(5) Paths for Heat Exchanger Unit Suitable for Top-Blow Arrangement and Bottom-Blow Arrangement (5-1) Details of Paths In the top-blow arrangement of the air conditioner 1, air passes the indoor heat exchanger 20 from bottom to top, whereas, in the bottom-blow arrangement, air passes the indoor heat exchanger 20 from top to bottom.

Therefore, one or more embodiments realize the same heat exchange performance in both the top-blow arrangement and the bottom-blow arrangement.

One or more embodiments realize the same heat exchange performance in both the top-blow arrangement and the bottom-blow arrangement by providing paths different from before. This is described below with reference to the drawings.

Figure 3A:
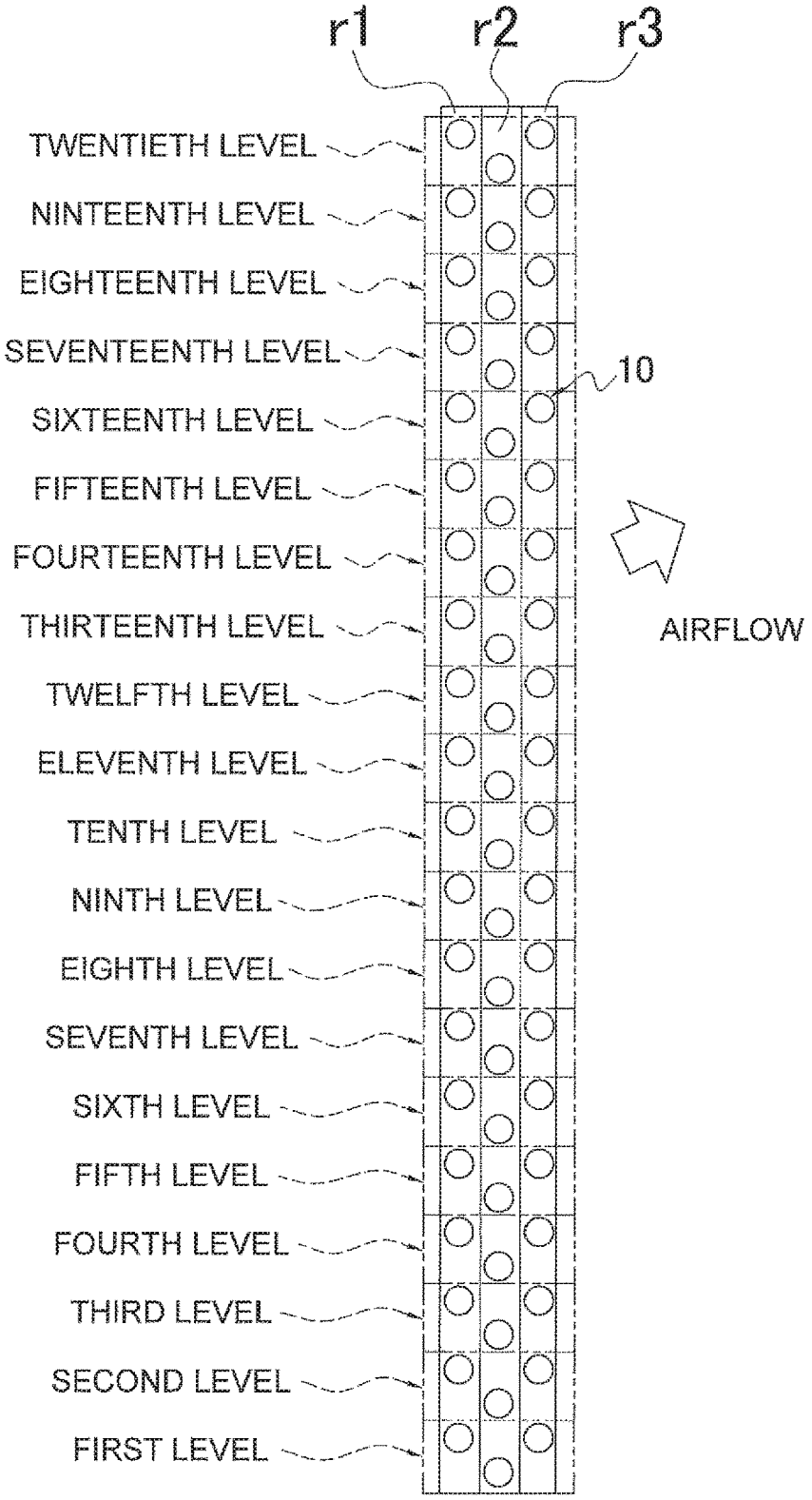
FIG. 3A is a schematic side view of one heat exchanging section.

FIG. 3A is a schematic side view of one heat exchanging section and, for convenience, shows a state in which the heat transfer tubes 10 are not connected to each other. In FIG. 3A, the solid white arrow denotes the direction of local air flow around the heat exchanging section. In the heat exchanging section, groups of the heat transfer tubes 10 that are arranged in L levels (here, L=20) in a direction that intersects the local air flow are arranged in M rows (here, M=3). That is, rows r1, r2, and r3 of the heat transfer tubes 10 are arranged in a direction (second direction) that is perpendicular to an L-level direction (first direction), the rows r1, r2, and r3 being arranged in 20 levels from bottom to top in front view of FIG. 3A.

Then, as a method of denoting each heat transfer tube 10 at a particular position, for example, the heat transfer tube 10 in row r1 and a third level from the bottom is denoted as <r1, 3>.

Figure 3B:
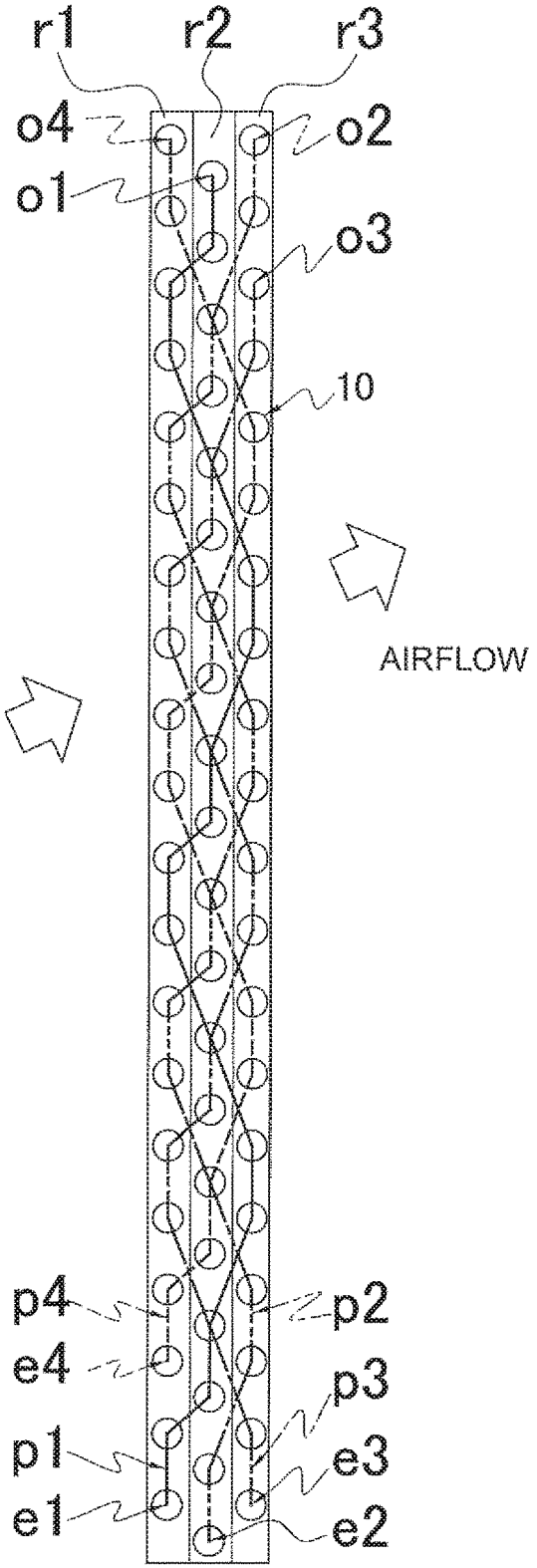
FIG. 3B is a schematic side view of the heat exchanging section in which four paths are drawn with lines at the same time on FIG. 3A.

N (here, N=4) paths are formed in the heat exchanging section 21. Although FIG. 3B shows the four paths drawn with lines at the same time on FIG. 3A, this is complicated and unclear. Therefore, the four paths are described by using drawings that each individually show a corresponding one of the four paths.

(5-1-1) First Path p1

Figure 4A:
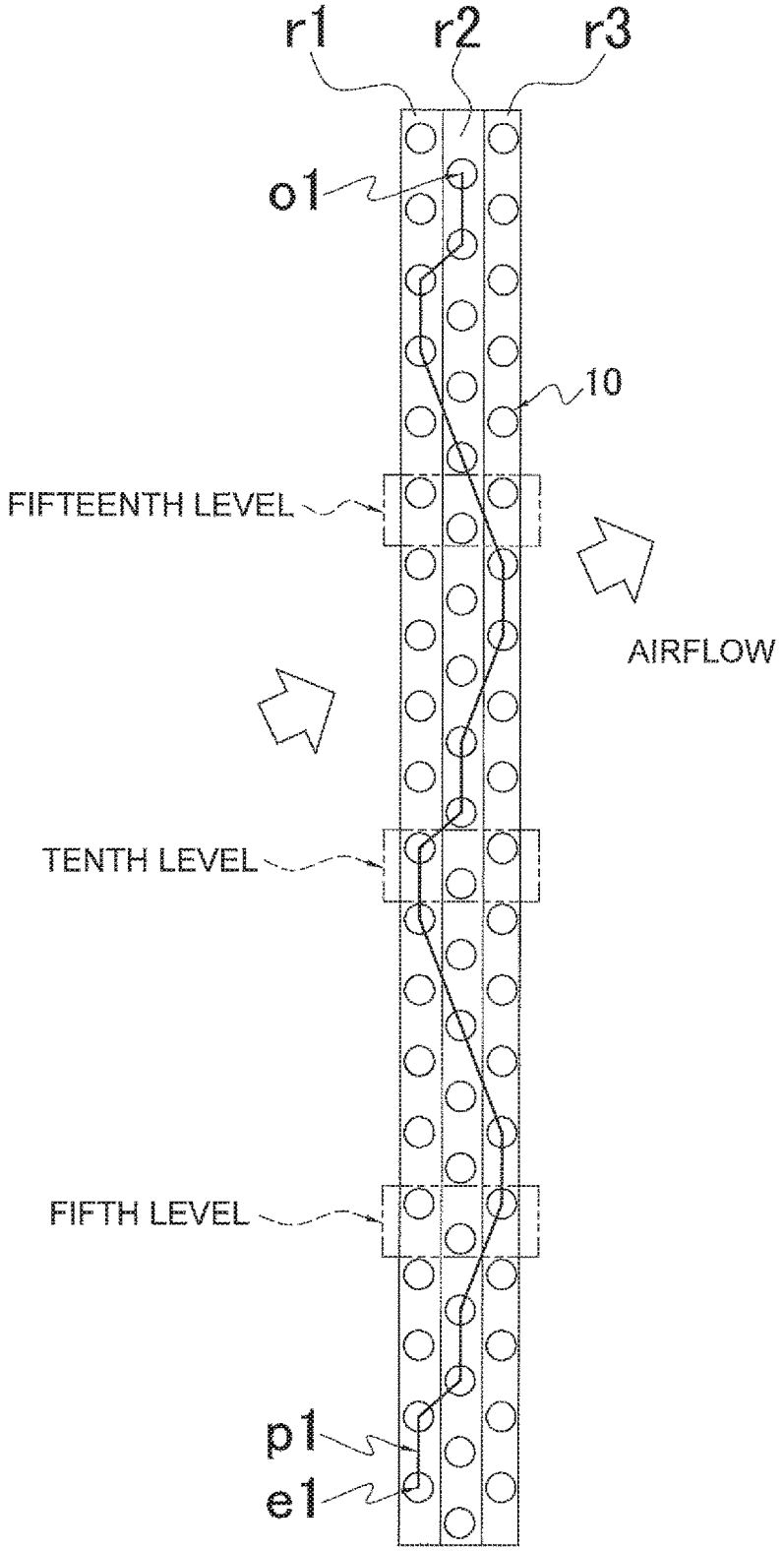
FIG. 4A is a schematic side view of the heat exchanging section and shows a first path of the four paths.

FIG. 4A is a schematic side view of the heat exchanging section and shows a first path p1 of the four paths. In FIG. 4A, the first path p1 passes through the heat transfer tubes 10 that are positioned at <r1, 1>, <r1, 2>, <r2, 3>, <r2, 4>, <r3, 5>, <r3, 6>, <r1, 9>, <r1, 10>, <r2, 11>, <r2, 12>, <r3, 13>, <r3, 14>, <r1, 17>, <r1, 18>, <r2, 19>, and <r2, 20>.

An inlet e1 of the first path p1 is provided at the heat transfer tube 10 that is positioned at <r1, 1>, and an outlet o1 is provided at the heat transfer tube 10 that is positioned at <r2, 20>.

(5-1-2) Second Path p2

Figure 4B:
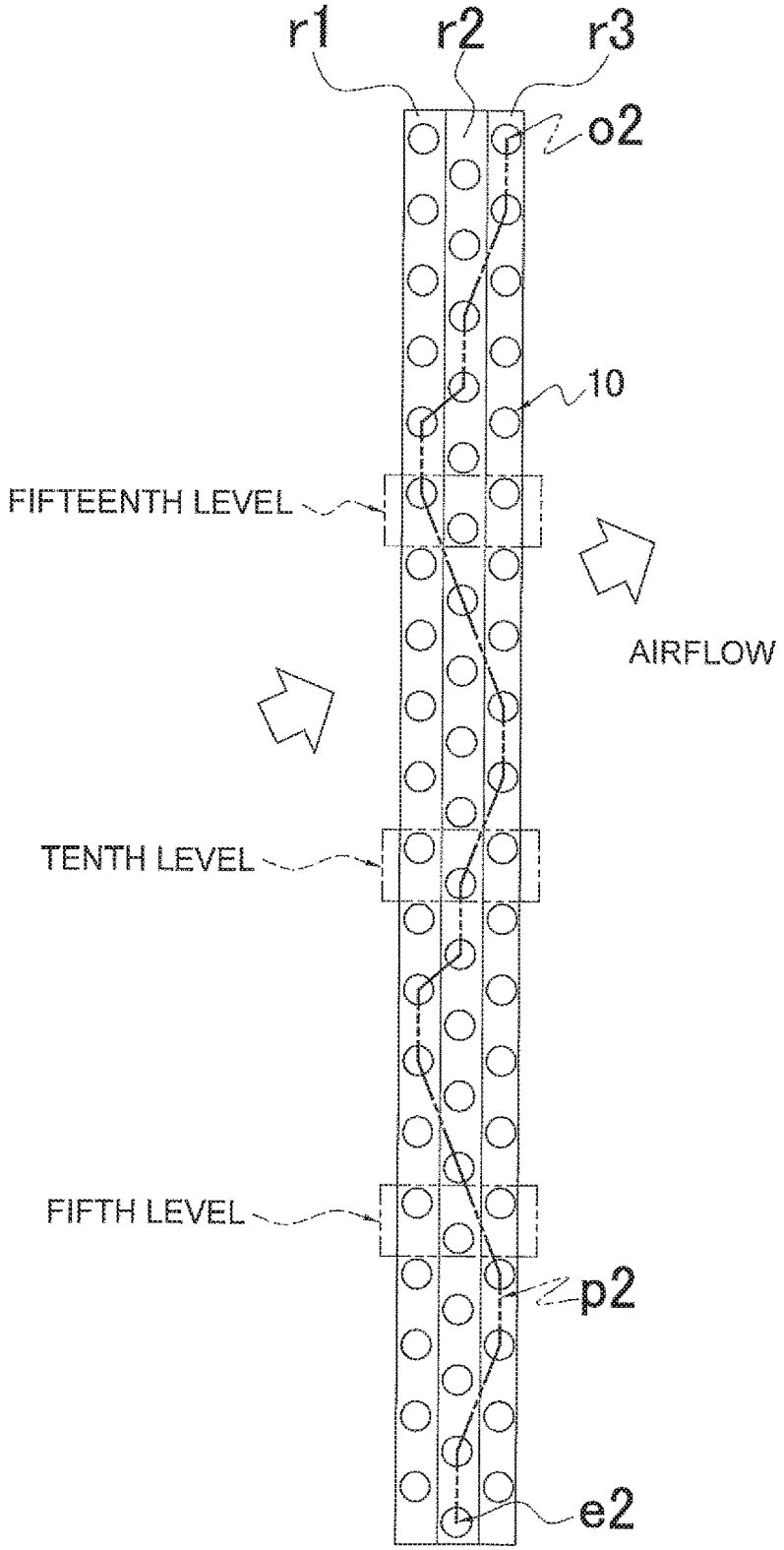
FIG. 4B is a schematic side view of the heat exchanging section and shows a second path of the four paths.

FIG. 4B is a schematic side view of the heat exchanging section and shows a second path p2 of the four paths. In FIG. 4B, the second path p2 passes through the heat transfer tubes 10 that are positioned at <r2, 1>, <r2, 2>, <r3, 3>, <r3, 4>, <r1, 7>, <r1, 8>, <r2, 9>, <r2, 10>, <r3, 11>, <r3, 12>, <r1, 15>, <r1, 16>, <r2, 17>, <r2, 18>, <r3, 19>, and <r3, 20>.

An inlet e2 of the second path p2 is provided at the heat transfer tube 10 that is positioned at <r2, 1>, and an outlet o2 is provided at the heat transfer tube 10 that is positioned at <r3, 20>.

(5-1-3) Third Path p3

Figure 4C:
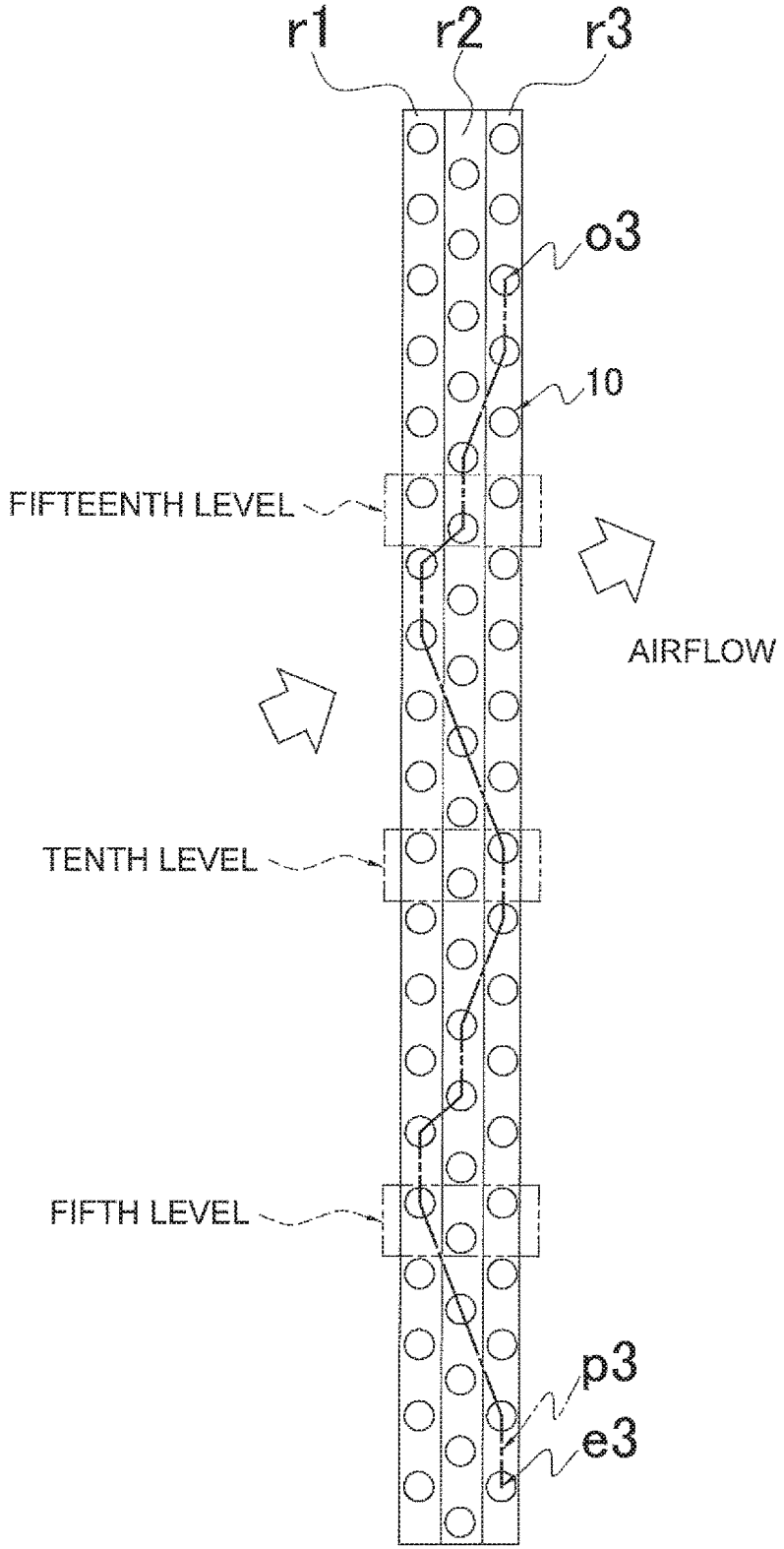
FIG. 4C is a schematic side view of the heat exchanging section and shows a third path of the four paths.

FIG. 4C is a schematic side view of the heat exchanging section and shows a third path p3 of the four paths. In FIG. 4C, the third path p3 passes through the heat transfer tubes 10 that are positioned at <r3, 1>, <r3, 2>, <r1, 5>, <r1, 6>, <r2, 7>, <r2, 8>, <r3, 9>, <r3, 10>, <r1, 13>, <r1, 14>, <r2, 15>, <r2, 16>, <r3, 17>, and <r3, 18>.

An inlet e3 of the third path p3 is provided at the heat transfer tube 10 that is positioned at <r3, 1>, and an outlet o3 is provided at the heat transfer tube 10 that is positioned at <r3, 18>.

(5-1-4) Fourth Path p4

Figure 4D:
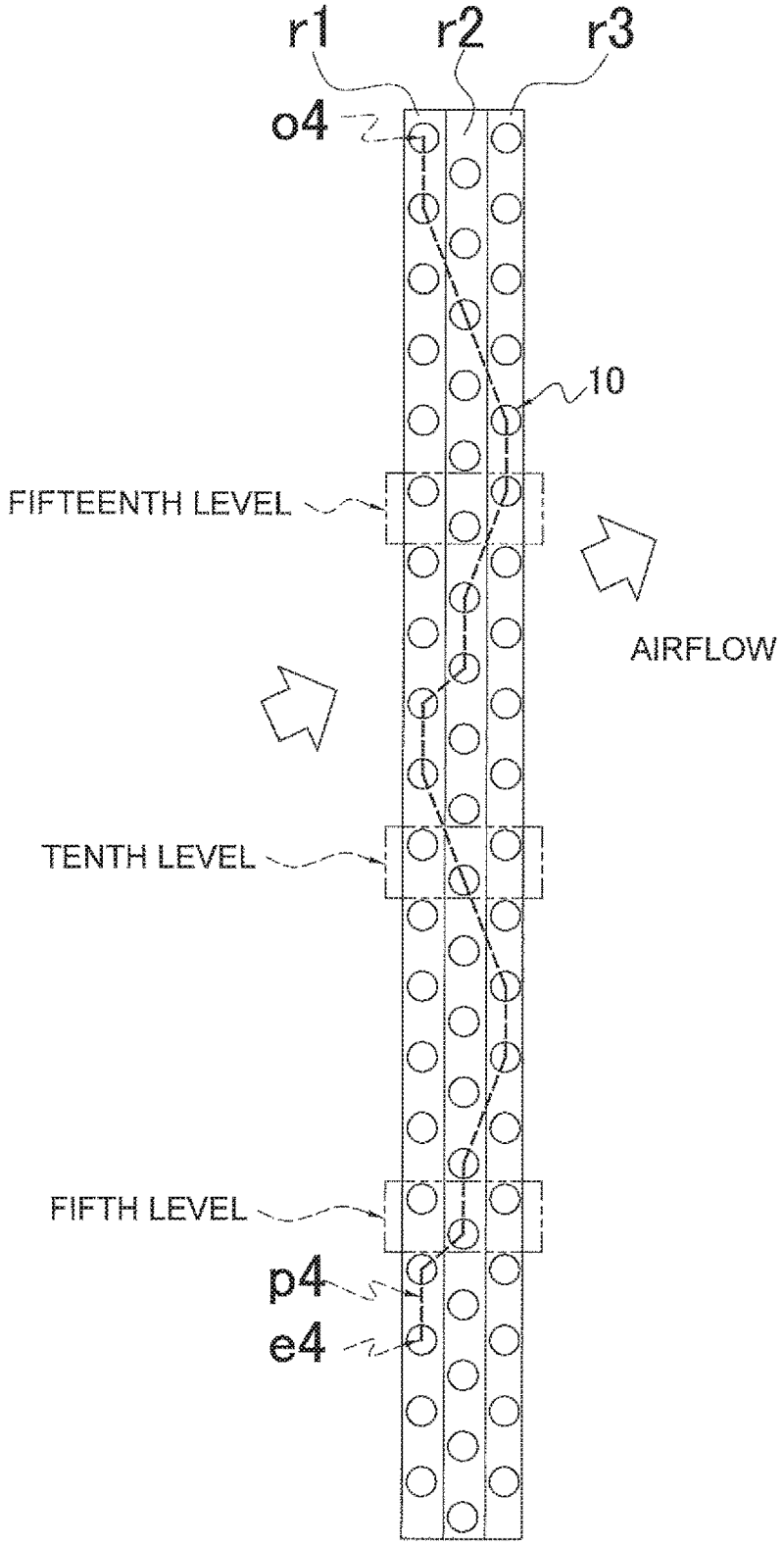
FIG. 4D is a schematic side view of the heat exchanging section and shows a fourth path of the four paths.

FIG. 4D is a schematic side view of the heat exchanging section and shows a fourth path p4 of the four paths. In FIG. 4D, the fourth path p4 passes through the heat transfer tubes 10 that are positioned at <r1, 3>, <r1, 4>, <r2, 5>, <r2, 6>, <r3, 7>, <r3, 8>, <r1, 11>, <r1, 12>, <r2, 13>, <r2, 14>, <r3, 15>, <r3, 16>, <r1, 19>, and <r1, 20>.

An inlet e4 of the fourth path p4 is provided at the heat transfer tube 10 that is positioned at <r1, 3>, and an outlet o4 is provided at the heat transfer tube 10 that is positioned at <r1, 20>.

(5-2) Features of Paths

The first path p1, the second path p2, the third path p3, and the fourth path p4 have the following three common features.

First, the first feature is that they all pass through the row r1, the row r2, and the row r3. This feature allows a variation width of the heat exchange performance when the direction of air flow that passes the heat exchanging section is reversed to be reduced.

Next, the second feature is that they pass back and forth between the row r1 and the row r3 at least once. For example, the first path p1 passes back and forth between the row r1 and the row r3 twice via each row in the order <r1, r1, r2, r2, r3, r3, r1, r1, r2, r2, r3, r3, r1, r1, r2, r2>. Similarly, the second path p2, the third path p3, and the fourth path p4 also pass back and forth between the row r1 and the row r3 twice.

This feature allows a path that passes through only a row on an upstream side of air flow or a row on a downstream side of the air flow to be removed, and the variation width of the heat exchange performance when the direction of air flow that passes the heat exchange section is reversed to be reduced.

The third feature is that the inlet of each path is positioned at the heat transfer tube 10 within a third level from a heat transfer tube 10 on one end side in any of the rows, and the outlet of each path is positioned at the heat transfer tube 10 within a third level from a heat transfer tube 10 on the other end side in any of the rows.

In the case of the first path p1, the inlet e1 is positioned at <r1, 1>, and the outlet o1 is positioned at <r2, 20>. In the case of the second path p2, the inlet e2 is positioned at <r2, 1>, and the outlet o2 is positioned at <r3, 20>. In the case of the third path p3, the inlet e3 is positioned at <r3, 1>, and the outlet o3 is positioned at <r3, 18>. In the case of the fourth path p4, the inlet e4 is positioned at <r1, 3>, and the outlet o4 is positioned at <r1, 20>.

This feature makes it possible to, when the heat exchanger unit is to function as an evaporator, provide a structure in which the heat transfer tube within the third level from a heat transfer tube on a lower end side is defined as an inlet of a liquid-rich two-phase refrigerant and the heat transfer tube within the third level from a heat transfer tube on an upper end side is defined as an outlet of a superheated gas refrigerant. Therefore, the top-blow arrangement and the bottom-blow arrangement both provide the same heat exchange performance.

If the heat transfer tube within a fifth level from a heat transfer tube on the lower end side is defined as an inlet of a liquid-rich two-phase refrigerant and the heat transfer tube within a fifth level from a heat transfer tube on the upper end side is defined as an outlet of a superheated gas refrigerant, substantially the same effects are obtained.

(5-3) Effects

Figure 5:
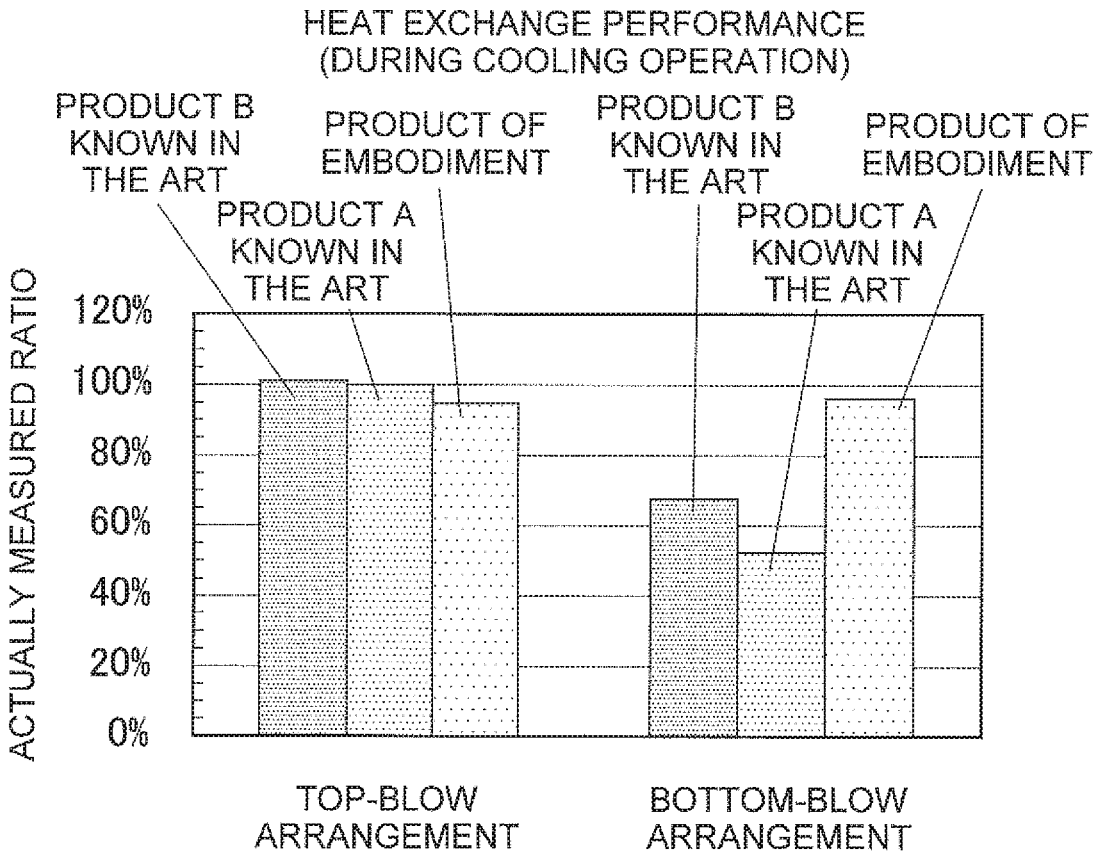
FIG. 5 shows graphs showing the relationship between the heat exchange performance of the heat exchanger unit including the heat exchanging section according to one or more embodiments and the heat exchange performance of heat exchanger units known in the art.

FIG. 5 shows graphs showing the heat exchange performance of the heat exchanger unit including the heat exchanging section according to one or more embodiment and the heat exchange performance of heat exchanger units known in the art. In FIG. 5, the three graphs on the left in front view indicate, from the left, the heat exchange performance of a product B known in the art, the heat exchange performance of a product A known in the art, and the heat exchange performance of a product according to one or more embodiments, each in the top-blow arrangement. The performance is indicated by a change in width ratio with reference to the "performance of the product A known in the art in the top-blow arrangement."

On the other hand, in FIG. 5, the three graphs on the right indicate, from the left, the heat exchange performance of the product B known in the art, the heat exchange performance of the product A known in the art, and the heat exchange performance of the product according to one or more embodiments, each in the bottom-blow arrangement. The performance is indicated by a change width ratio with reference to the "performance of the product A known in the art in the top-blow arrangement."

As shown in FIG. 5, for the heat exchanger units known in the art, the heat exchange performance of the product A known in the art in the bottom-blow arrangement is reduced by approximately 47% compared to the heat exchange performance of the product A known in the art in the top-blow arrangement, and the heat exchange performance of the product B known in the art in the bottom-blow arrangement is reduced by approximately 33% compared to the heat exchange performance of the product B known in the art in the top-blow arrangement.

In contrast, the heat exchanger unit including the heat exchanging section according to one or more embodiments provides a heat exchange performance in the bottom-blow arrangement that is substantially the same as the heat exchange performance in the top-blow arrangement. That is, this shows that, by having the three features described above, even if the direction of air flow is reversed, the same heat exchange performance is realized.

Therefore, by applying the heat exchanging section of this heat exchanger unit to the heat exchanging sections 21, 22, and 23 of the indoor heat exchanger 20, it is possible to "realize the same heat exchange performance even if the direction of air flow that moves past the heat exchanging section is reversed."

(6) Modification

In the heat exchanger unit, a path that does not pass through one row or some of the rows increases the heat exchange performance with respect to a unidirectional air flow that passes the heat exchanging section and reduces the heat exchange performance with respect to a reverse-direction air flow.

In an actual design, a heat exchanging section may need to include a path that does not pass through one row or some of the rows.

However, even in such a case, by setting the number of paths that pass through all of the rows larger than the number of paths that do not pass through one row or some of the rows, it is possible to reduce the variation width of the heat exchange performance when the direction of air flow that passes the heat exchanging section is reversed.

(7) Features (7-1)

In the heat exchanger unit and the air conditioner 1 using the heat exchanger unit, the heat exchanging section has a structure in which groups of the plurality of heat transfer tubes that are arranged in L or more levels in a direction that intersects the air flow are arranged in M rows in the direction of the air flow, the plurality of heat transfer tubes form N paths, and M<N. The number of paths that pass through all of the rows at least once is set at one or more, and the influence of a row where the heat exchange performance is enhanced with respect to only a unidirectional air flow that passes the heat exchanging section is reduced, to make it possible to reduce the variation width of the heat exchange performance when the direction of air flow that passes the heat exchanging section is reversed.

(7-2)

The heat exchanger unit allows a path that passes through only a row on the upstream side of the air flow or a row on the downstream side of the air flow to be removed, to reduce the variation width of the heat exchange performance when the direction of air flow that passes the heat exchanging section is reversed.

(7-3)

The heat exchanger unit makes it possible to reduce the size of the heat exchanging section.

(7-4)

When this heat exchanger unit is to function as an evaporator, it is possible to provide a structure in which the heat transfer tube within the third level from a heat transfer tube on the lower end side is defined as an inlet of a liquid-rich two-phase refrigerant and the heat transfer tube within the third level from a heat transfer tube on the upper end side is defined as an outlet of a superheated gas refrigerant. Therefore, the top-blow arrangement and the bottom-blow arrangement both provide the same heat exchange performance.

If the structure is one in which the heat transfer tube within the fifth level from a heat transfer tube on the lower end side is defined as an inlet of a liquid-rich two-phase refrigerant and the heat transfer tube within the fifth level from a heat transfer tube on the upper end side is defined as an outlet of a superheated gas refrigerant, substantially the same effects are obtained.

Occurrence of refrigerant drift caused by the influence of gravity exerted upon a liquid refrigerant is suppressed, and concern for a reduction in performance is overcome.

(7-5)

When the heat exchanger unit is to function as a condenser, since a path in which a liquid refrigerant produced by condensation moves upward and a path in which a liquid refrigerant produced by condensation moves downward do not coexist, refrigerant drift caused by the influence of gravity exerted upon the liquid refrigerant no longer occurs, and concern for a reduction in performance is overcome.

As described above, since the same heat exchange performance is realized even if the direction of air flow that moves past the heat exchanging section of the heat exchanger unit is reversed, the present invention is widely useful in fields that use a heat exchanger unit.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner
10 heat transfer tube
20 indoor heat exchanger (heat exchanger unit)
21 heat exchanging section
22 heat exchanging section
23 heat exchanging section

The invention claimed is:

1. An air conditioner comprising:

a heat exchanger unit comprising:

a heat exchanging section that includes:

a plurality of heat transfer fins; and a plurality of heat transfer tubes; and a fan that generates an air flow that passes in a vertical direction substantially parallel to a direction of gravity when the heat exchanger unit is installed, wherein each of the plurality of heat transfer tubes:

extends in a first horizontal direction substantially perpendicular to the vertical direction when the heat exchanger unit is installed, and passes through a corresponding one of the plurality of heat transfer fins, in the heat exchanging section, the plurality of heat transfer tubes are arranged in L levels or more in the vertical direction and in M rows in a second horizontal direction that is perpendicular to the vertical direction and the first horizontal direction, each of the plurality of heat transfer tubes belongs to one of N paths, $3 \leq M < N$, all of the N paths pass through all of the M rows at least once, inlets of all of the N paths are disposed at a first end of the heat exchanging section in the vertical direction, outlets of all of the N paths are disposed at a second end of the heat exchanging section in the vertical direction, a refrigerant flows through each of the N paths from one of the inlets to a corresponding one of the outlets, the refrigerant that flows through one of the plurality of heat transfer tubes at a first level among the L levels subsequently flows at a second level among the L levels, where the first level is not closer to the corresponding one of the outlets than the second level is in any part of the N paths, the heat exchanger unit is installed in a same vertical orientation when the fan is installed upside down such that a direction of the air flow is reversed, and each of the N paths runs back and forth at least once between a row that is disposed most upstream with respect to the second horizontal direction and a row that is disposed most downstream with respect to the second horizontal direction.

2. The air conditioner according to claim 1, wherein an outside diameter of each of the plurality of heat transfer tubes is 9 mm or less.

3. The air conditioner according to claim 1, wherein each of the inlets of the N paths is disposed at one of the plurality of heat transfer tubes that is within five levels of the first end in the vertical direction and in any one of the M rows, and each of the outlets of the N paths is disposed at one of the plurality of heat transfer tubes that is within five levels of the second end in the vertical direction and in any one of the M rows.

* * * * *